United States Patent [19]

Hall

[11] 4,401,230

[45] Aug. 30, 1983

[54] SNAP CLOSURE

[76] Inventor: John L. Hall, 2020 Lincoln Ave., Pasadena, Calif. 91103

[21] Appl. No.: 385,477

[22] Filed: Jun. 7, 1982

[51] Int. Cl.[3] ..... B65D 43/14; B65D 51/04

[52] U.S. Cl. ..... 220/339; 220/306

[58] Field of Search ..... 220/306, 307, 339; 150/0.5; 206/1.5

[56] References Cited

U.S. PATENT DOCUMENTS 4,183,446 1/1980 Davis ..... 220/306

4,219,116 8/1980 Borkan ..... 220/306

4,363,403 12/1982 Raucci, Jr. et al. ..... 220/339

*Primary Examiner*—George T. Hall

*Attorney, Agent, or Firm*—Allan M. Shapiro

[57] ABSTRACT

Housing has a top and bottom and has a living hinge joining them so that the top and bottom are of monolithic construction of a thermoplastic polymer composition flexible material. The top and bottom are configured so that opposite the hinge an edge on the top with a catch thereon enters between a flange and latch on the bottom so that the latch resiliently engages over the catch to detachably hold the top and bottom in the closed position.

10 Claims, 7 Drawing Figures

SNAP CLOSURE

BACKGROUND OF THE INVENTION

This invention is directed to a snap closure of a particular design which permits the snap closure to properly retain and release opposite parts when the opposite parts are made of a resilient thermoplastic polymer composition material.

Injection molding of housings employing thermoplastic polymer composition material is an economical way of producing such housings. In the conventional construction, the top and bottom are separately molded of relatively rigid material which may be thermoplastic or thermosetting plastic. Hinges are provided so that the top and bottom may swing open and closed with respect to each other. A closure device is provided opposite the hinge, and as long as the top and bottom are both of relatively rigid construction, the latching forces can be resolved back to the hinge. However, for more flexible and resilient molding material, such catches are unsatisfactory because the flexibility of the top and bottom of the housing do not permit the continued maintenance of adequate snap closure forces. Thus, there is need for a construction whereby a snap closure maintains its latching and unlatching characteristics even when molded of resilient material.

SUMMARY OF THE INVENTION

In order to aid in the understanding of this invention, it can be stated in essentially summary form that it is directed to a molded housing having a top and a bottom and each having an edge, with a catch on one edge and a latch on the other. A flange is positioned opposite the latch to engage the other edge therebetween for a properly acting snap closure.

It is, thus, an object of this invention to provide a snap closure which is capable of being molded in resilient thermoplastic polymer composition material and provide good closure retention and closure release capabilities.

It is a further object to provide a snap closure in a housing having a top and a bottom with a living hinge therebetween and a snap closure opposite the living hinge so that the entire structure can be molded in one piece, with the snap closure providing reliable retention and release over a long life.

It is a further object to provide a snap closure for a housing having a top and bottom with facing edges, with one of the edges provided with a channel into which at least a portion of the opposite edge is received for relative restraint of the edges for provision of a reliable snap closure.

The features of the present invention which are believed to be novel are set forth with particularlity in the appended claims. The present invention, both as to its organization and manner of operation, together with further objects and advantages thereof, may be best understood by reference to the following description, taken in conjunction with the accompanying drawings.

DESCRIPTION OF THE PREFERRED EMBODIMENT

Figure 2:
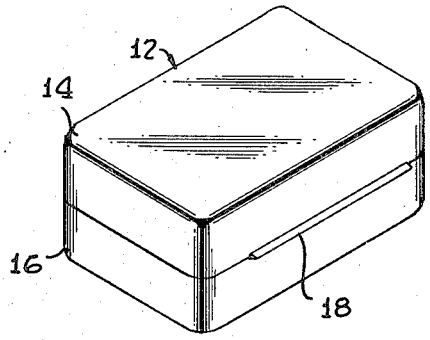
FIG. 2 is an isometric view of the rear of the same housing.
Figure 4:
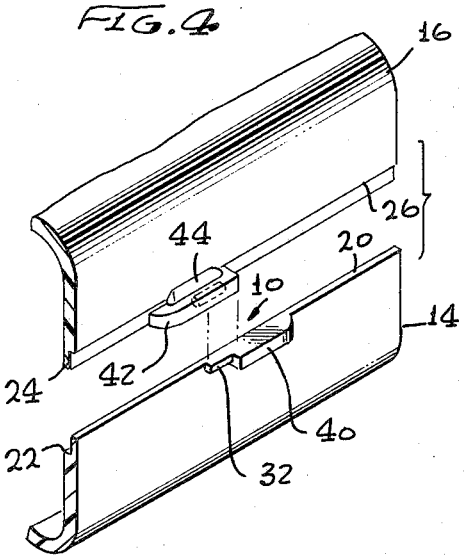
FIG. 4 is a view similar to FIG. 3, with the snap closure shown in inverted position.

Snap closure 10 of this invention is particularly useful when employed with a housing made of soft or resilient material. Thus, snap closure 10 is illustrated in conjunction with housing 12. Housing 12 can be of any convenient shape or structure to enclose the contents in question. In the present case, housing 12 has a top 14 and bottom 16 which have front, side and back walls of the same depth on the top and bottom so that they are substantially equally recessed. Snap closure 10 is particularly designed to be useful on a housing which is injection-molded of relatively soft and flexible thermoplastic synthetic polymer composition material, of which polypropylene is an example. In view of the flexibility of the material from which housing 12 is made, it is convenient to mold the housing 12 in one piece with a living hinge 18, see FIGS. 2 and 5. When a living hinge is employed, the use of polypropylene as a material from which the housing is formed is particularly advantageous because properly formulated and molded polypropylene becomes more flexible with use and does not break from brittle failure at the hinge.

Figure 3:
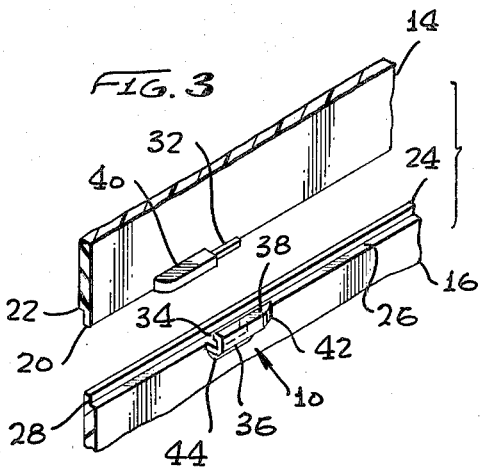
FIG. 3 is an enlarged isometric view, with parts broken away, showing the snap closure of this invention. in the upright position.
Figure 5:
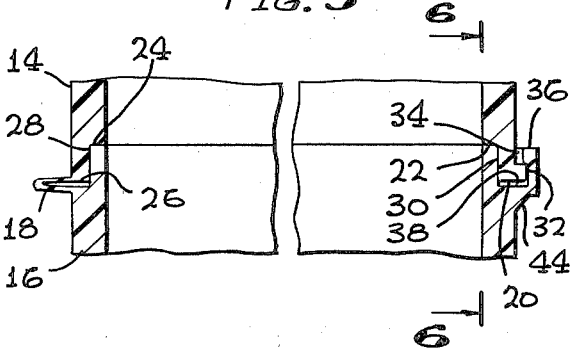
FIG. 5 is an enlarged section taken generally along the line 5—5 of FIG. 1, with parts broken away.

The top 14 and bottom 16 of housing 12 face each other and are releaseably latched together by snap closure 10. As is seen in FIGS. 3 and 5, top 14 terminates in edge 20 interiorly of which there is a recess 22. As is seen in FIG. 5, edge 20 and recess 22 extend all the way around the lower periphery of top 14. That portion of the bottom 16 which faces those portions of the top are flange 24 and lip 26. These features extend all the way around the periphery of bottom 16. It is important to note that flange 24 extends upwardly into top 14 interiorly of edge 20 and substantially engages against recess 22. Similarly, edge 20 substantially engages against lip 26 when the top is closed with respect to the bottom. These peripheral features of the top and bottom are sufficiently loose so that the top may be raised away from the bottom, hinging on living hinge 18 to open, and subsequently close the housing. The outer surface 28 of edge 24 engages around the inner surface 30 of edge 20. When in the closed position, this interengagement provides lateral positioning of top 14 with respect to bottom 16.

Snap closure 10 is formed with a catch 32 formed on the outside of edge 20 and with a latch 34 formed on the bottom 16 adjacent lip 26. As is seen in FIGS. 3 and 5, wall 36 is formed on the outside of bottom 16 and extends upwardly beyond lip 26, substantially even with the top edge of flange 24. Upstanding wall 36 defines channel 38 between outer surface 28, lip 26 and wall 36. When in the closed position, edge 20 extends down into this channel. On the upper interior of wall 36, the latch 34 is formed as an inwardly directed rib. Similarly, catch 32 is formed on the lower, outer surface of edge 20 as a protrusion. Both protrusions extend generally parallel to the length of edge 20 and substantially parallel to the hinge line of living hinge 18.

The resiliency of wall 36 permits latch 34 to swing outwardly away from catch 22 to permit the entry of the catch into the channel and to permit the release of the catch from the channel. Catch 32 is maintained in resilient engagement position with latch 34 by engagement of the inner surface 30 of edge 20 against the outer surface 28 of flange 24. Thus, flexure of the top and bottom of the housing toward or away from the hinge does not change the engagement of the latch with respect to the catch. The backup force provided by inner surface 30 engaging on outer surface 28 at a position directly opposite where catch 32 engages on latch 34 provides the positive snap closure action.

Figure 1:
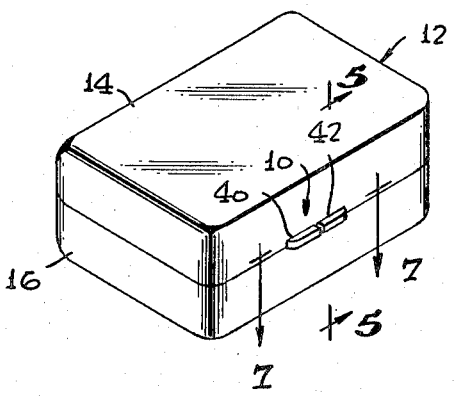
FIG. 1 is an isometric view of the front of a housing having the snap closure of this invention.
Figure 6:
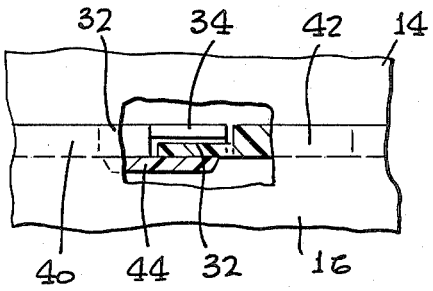
FIG. 6 is a section taken generally along the line 6—6 of FIG. 5, with parts broken away.
Figure 7:
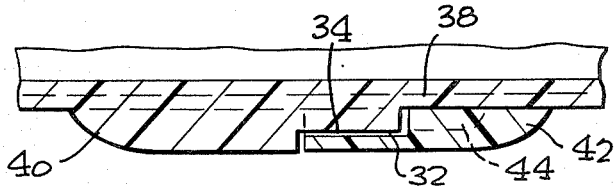
FIG. 7 is an enlarged section through the snap closure, taken generally along the line 7—7 of FIG. 1, with parts broken away.

Closure of the housing 12 easily accomplished by pressing the top down onto the bottom. Edge 20 enters channel 28 so that catch 32 and latch 34 interengage. Wings 40 and 42 are respectively secured to the top and bottoms 14 and 16 adjacent catch 32 and latch 34. They are positioned so that when they are engaged by the forefinger and thumb of the right hand, respectively, and the thumb and finger are twisted in the clockwise direction, an opening couple is produced. It is convenient to form the wing 42 in line with wall 36 so that they are in line with each other and show a continuous surface. In view of the fact that the space under latch 34 is wider than the channel 38, some reinforcement such as fillet 44 can be provided for strengthening the portion adjacent latch 34. As is seen in FIGS. 3 and 6, latch 34 can be formed as a continuation of wing 40, but of smaller size. As is seen in FIGS. 1 and 7, the wings 40 and 42 are of substantially equal length and are directly adjacent each; and, as seen in FIG. 1, these wings are substantially centrally located at the periphery of the top and bottom opposite the hinge. As is seen in FIG. 7, the channel 38 passes behind wing 42, and the latch 34 is formed within the length of the wing 42. Thus, the wings 40 and 42 are directly associated with catch 32 and latch 34 so that when they are grasped and force in the opening direction is applied, the opening force is applied directly at the catch and latch so that it is directly effective in opening of the snap closure. The catch and latch are designed for a positive feeling snap in both the opening and closing operation. Thus, a snap closure which can be molded into a housing of soft and resilient thermoplastic synthetic polymer composition material is achieved.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A snap closure for a housing having a top portion and a bottom portion;

one of said portions having a lip on the periphery thereof and a flange upstanding past said lip;

the other of said portions having an edge on a portion of the periphery thereof and a recess adjacent said edge so that when said portions are adjacent each other, said flange enters said recess so that said flange and said edge overlap;

a wall integrally formed adjacent said lip and standing upward spaced from and adjacent said flange to define a channel between said flange and said wall, said edge extending into said channel between said wall and said flange; and a latch on said wall and a catch on said edge so that said catch and said latch interengage when said portions are engaged with each other, said latch being formed of resilient material so that said latch is deflected away from said flange when said catch enters and leaves said channel.

2. The snap closure of claim 1 wherein said snap closure is on a housing having a top and a a bottom, and said top and said bottom are hinged together opposite said snap closure.

3. The snap closure of claim 2 wherein said housing is injection-molded of flexible thermoplastic synthetic polymer composition material.

4. The snap closure of claim 3 wherein said top and said bottom of said housing are monolithically formed with a living hinge.

5. The snap closure of claim 4 wherein first and second wings are respectively formed on said portions adjacent said snap closure so that said wings may be finger-engaged for manual disengagement of said snap closure.

6. A housing comprising:

a top and a bottom, each of said top and said bottom having a peripheral edge, a hinge connecting said top and said bottom adjacent one portion of said peripheral edge, said housing being monolithically formed of flexible thermoplastic synthetic polymer composition material with said hinge forming a living hinge as part of said monolithic structure and forming a hinge between said top and said bottom;

a snap closure on said periphery of said top and said bottom away from said hinge, the portion of said periphery adjacent said snap closure on said top comprising an edge extending beyond a recess and the opposing periphery of said bottom including a flange extending beyond a lip so that when said top and bottom in a closed position, said flange overlaps said edge and extends into said recess and said edge substantially reaches said lip;

a wall adjacent said recess and extending substantially to the height of said flange and defining a channel between said wall and said flange, which channel extends down to said lip so that when said periphery of said top is moved adjacent said periphery of said bottom, said edge engages in said channel;

a latch adjacent said channel and facing said flange, a catch on said edge positioned to interengage with said latch when said top of said housing is closed on said bottm of said housing so that said snap closure detachably retains said top adjacent said bottom of said housing.

7. The housing of claim 6 wherein said snap closure has its wall formed as a manually graspable wing secured to said bottom and there is also a manually graspable wing formed as a portion of said top and positioned adjacent said wing on said bottom when said snap closure is closed so that both of said wings can be manually grasped for opening said housing.

8. The housing of claim 7 wherein said wall is formed as part of said wing on said bottom and said latch is formed as part of said wing on said bottom.

9. The housing of claim 8 wherein said wing formed as part of said top lies directly adjacent said catch.

10. The housing of claim 7 wherein said edge lies against said flange and said latch and said catch are interengaged.

* * * * *